US005950310A

United States Patent [19]

Kanayama et al.

[11] Patent Number: 5,950,310

[45] Date of Patent: Sep. 14, 1999

[54] FORGED ROLL FOR ROLLING A SEAMLESS STEEL PIPE AND MANUFACTURING METHOD OF SAME

[75] Inventors: Taro Kanayama; Akira Yorifuji; Toshiaki Kasuya, all of Aichi; Yuichiro Sato, Toyama; Shoitsu Seo, Toyama; Satoshi Matsuoka, Toyama, all of Japan

[73] Assignees: Kawasaki Steel Corporation; Pacific Steel Mfg. Co., Ltd., both of Japan

[21] Appl. No.: 09/095,814

[22] Filed: Jun. 11, 1998

Related U.S. Application Data

[62] Division of application No. 08/881,231, Jun. 24, 1997, Pat. No. 5,813,962.

[30] Foreign Application Priority Data

Jun. 28, 1996 [JP] Japan ..... 8-170328

[51] Int. Cl.[6] ..... B23Q 7/10

[52] U.S. Cl. ..... 29/895.33; 29/895.3

[58] Field of Search ..... 29/895.3, 895.33; 148/544, 321; 492/58, 54, 57, 53, 1

[56] References Cited

U.S. PATENT DOCUMENTS

| | | | |
|---|---|---|---|
| 3,411,957 | 11/1968 | Takai et al. . | |
| 3,423,250 | 1/1969 | Morizumi et al. | 29/895.33 |
| 4,191,559 | 3/1980 | Stickels | 492/58 |
| 4,989,306 | 2/1991 | Leino et al. | 492/58 |
| 5,225,007 | 7/1993 | Hattori et al. | 148/541 |
| 5,283,121 | 2/1994 | Bordner | 492/58 |
| 5,305,522 | 4/1994 | Nawata et al. | 29/895.33 |
| 5,411,462 | 5/1995 | Link | 492/58 |
| 5,445,589 | 8/1995 | Shimizu | 492/58 |
| 5,484,372 | 1/1996 | Nawata et al. | 492/58 |
| 5,505,682 | 4/1996 | Shimizu | 492/58 |

FOREIGN PATENT DOCUMENTS

| | | |
|---|---|---|
| 0 395 477 | 10/1990 | European Pat. Off. . |
| 57-126914 | 8/1982 | Japan . |
| 60-012211 | 1/1985 | Japan . |
| 1 025 680 | 4/1966 | United Kingdom . |

*Primary Examiner*—I. Cuda
*Attorney, Agent, or Firm*—Austin R. Miller

[57] ABSTRACT

A forged roll for rolling a seamless steel pipe, having excellent biting properties and wear resistance, and manufacturing method. The forged roll comprises a high carbon alloy cast steel comprising about 1.10–1.85 wt % carbon, about 0.3–1.2 wt % silicon, about 0.4–1.5 wt % manganese, about 0.5–2.0 wt % nickel, about 0.5–2.0 wt % chromium and iron. Heat treatment for spheroidal carbide formation is performed so that the spheroidal carbide covers about 35–55% of the area of the roll metallurgical structure.

6 Claims, 5 Drawing Sheets

SYMBOLS X, ● and ○ DENOTE HARDNESS AFTER USING

LINE — DENOTES HARDNESS BEFORE USING

FORGED ROLL FOR ROLLING A SEAMLESS STEEL PIPE AND MANUFACTURING METHOD OF SAME

This application is a divisional of application Ser. No. 08/881,231, filed Jun. 24, 1997, incorporated herein by reference, now U.S. Pat. No. 5,813,962.

BACKGROUND OF THE INVENTION

1. Field of the Invention

The present invention relates to a rolling roll for manufacturing seamless steel pipe, and a method for making the roll. More specifically, the present invention relates to technology, in manufacturing seamless steel pipe by means of the Mannesmann system, for improving wear resistance of a roll used in a rolling mill, and its heat crack resistance, biting properties, preventing surface roughness and the like, all by combining special ingredients of the roll and the metallurgical structure of the roll.

2. Description of the Prior Art

In manufacturing seamless steel pipe by the use of the Mannesmann system, the biting property of the roll upon the pipe is an essential factor in order to achieve advantageous rotary forging. But it is not enough simply to apply a little soft material to the roll to be used to improve its biting upon the steel pipe, because of the resulting loss of wear resistance.

To reduce the manufacturing cost of the seamless steel pipe, it is very important to extend the working lives of rolls needed to be used. Furthermore, if a stainless type steel pipe is manufactured with a roll that has poor wear resistance, it is difficult to ensure the surface quality of the inner and outer surfaces of the steel pipe. Accordingly, a roll having a so-called Adamite type material has been manufactured by centrifugal casting. However, notwithstanding its wear resistance, the roll is ineffective on seamless steel pipe because the problem of its biting property remains.

Referring to FIG. 4 of the drawings, a piercer roll 1 is so arranged that the roll is inclined at a stand. The piercer roll 1 is different from a normal roll and comprises three portions: (a) an introducing portion (entrance) 2 for the material 5 to be rolled, (b) a contributing portion 3 to the rolling and (c) a delivery portion 4 of the material 5.

Since respective portions of the rolls have different functions, the characteristic necessary for the roll material is that each portion of the same roll shall differ from the others. That is, at the entrance 2 for the material 5 to be rolled, the biting property of the roll upon the material to be rolled is important. On the surface of the entrance 2, some surface roughness must be maintained to provide friction. In addition, at the contributing portion 3 at a center portion of the roll, the roll material needs wear resistance and needs to prevent excessive surface roughness. At the delivery portion 4, the material 5 to be rolled must be stably held by the roll; accordingly, some surface roughness and wear resistance are required there. It is difficult for any current technique to satisfy such a difficult combination of requirements.

Moreover, in such a piercer roll 1 significant work hardness develops near the entrance 2, and considerable friction arises at the roll center portion 3, and these influences must be overcome. To improve wear resistance, at least a portion of the roll material must have a high carbon content (for example, 1.9 wt %). While the surface roughness of the roll surface is thereby temporarily improved, another problem arises. During working, poor biting due to work hardness at the entrance 2 causes slippage of the material 5 to be rolled. This results in seizing and damage. More specifically, in case of excessively poor biting, the material 5 to be rolled cannot be bitten, sometimes entirely preventing rolling. When the roll is made of a tool steel material which has a lower carbon content than the roll material, such as 1 wt %, which has a relatively high hardness, excellent wear resistance is obtained, and biting effectiveness is also maintained at the entrance side portion 2. However, this causes deep heat cracking to occur at the contributing portion 3, which causes the roll surface portion to break off.

Japanese Patent Publication No. 44-17022/1969 and Japanese Patent Publication No. 48-7180/1973 are of interest. They provide a method for preventing heat cracking and break-off of the roll surface wherein, in manufacturing the roll, roll toughness is far advanced by hot-forging the roll after forging. However, the rolls manufactured by this technique have high surface hardness but poor biting properties.

SUMMARY OF THE INVENTION

It is accordingly an object of the present invention to provide a forged roll for rolling a seamless steel pipe, which combines two inconsistent characteristics that heretofore seemed to be unrealizable in the same roll, to provide both excellent biting properties and excellent wear resistance. Another object is to provide a novel manufacturing method for the roll.

DETAILED DESCRIPTION OF THE INVENTION

Figure 3:
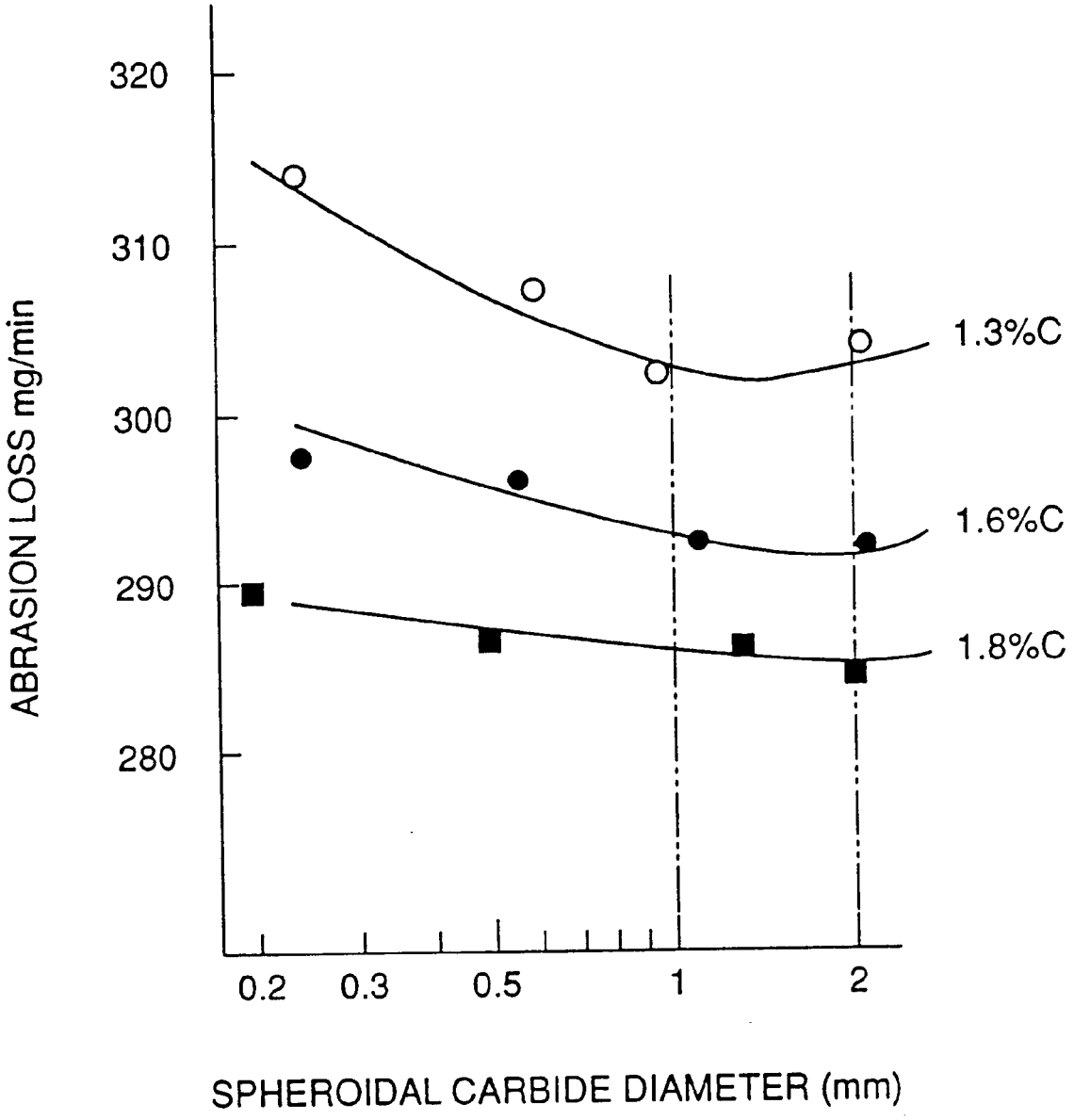
FIG. 3 shows relationships between size of spheroidal carbide dispersed in a roll matrix and the abrasion loss obtained by attrition testing.
Figure 4:
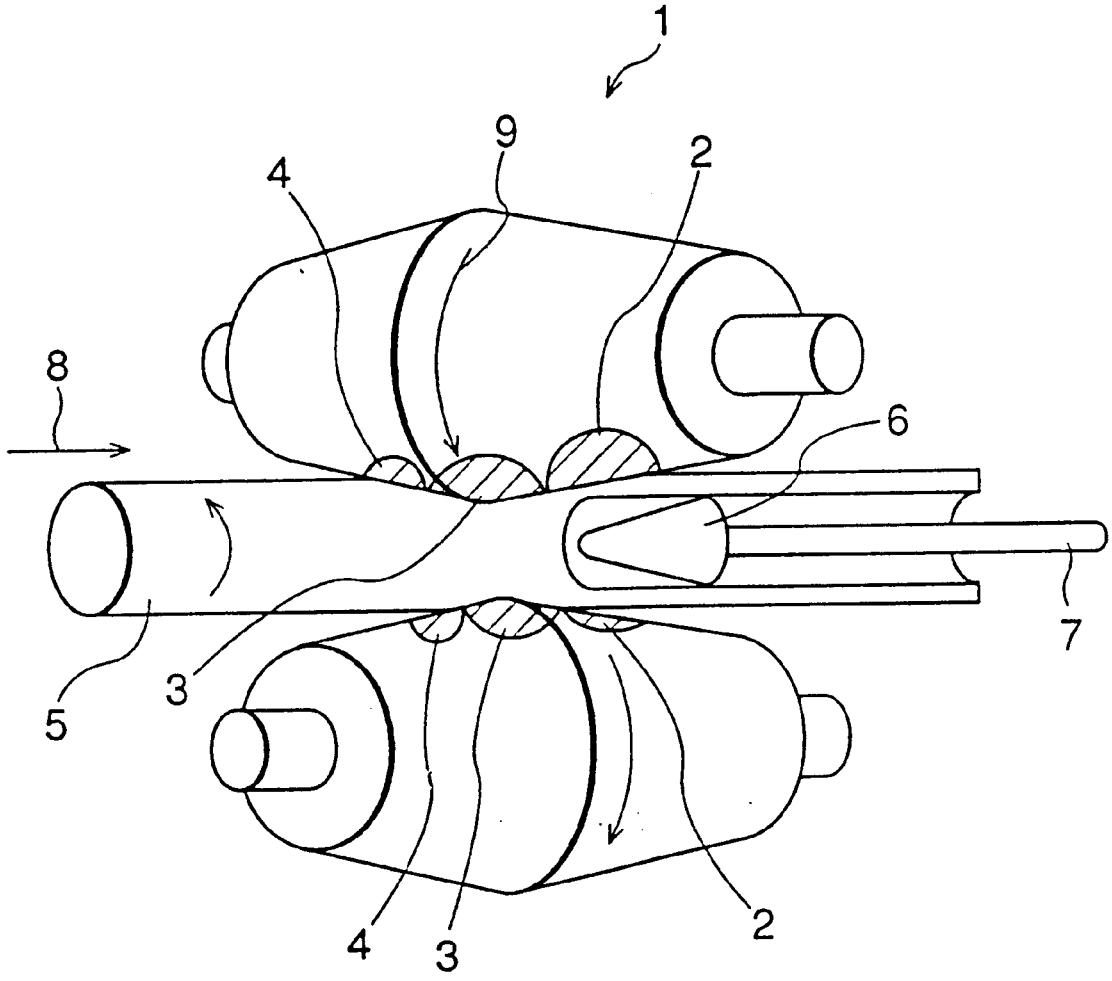
FIG. 4 is a perspective view of a piercer roll.

It has been found that, in order to obtain good roll wear resistance, a hard spheroidal carbide may be dispersed in a soft matrix of the roll. Such a roll surface may have a Shore scleroscope hardness Hs of about 29 to 34, for example. In this case, as shown in FIG. 3, it has been found that a coarse carbide of about 1 to 2 $\mu m\phi$ has better wear resistance properties than fine carbides. Furthermore, the spheroidal carbide may cover about 35 to 55% of the area of the roll metallurgical structure, and a coarse bar or bulk carbide may cover about 3 area % or less of the metallurgical structure.

However, when the carbide content is reduced down to about 1.5 wt % or less, this creates network carbide of the type which appears in an Adamite type roll member, and is unsuitable for providing wear resistance, and which may not completely disappear under heat treatment alone. Accordingly, we have found that it is necessary to apply a mechanical force such as forging in making the roll.

Deterioration of biting capability occurs due to work hardness of the roll member, and to surface smoothing. However, the Shore scleroscope hardness Hs of a roll surface may be maintained at about 29 to 34, whereby a relatively large spheroidal carbide is deposited. Then, the more the roll surface is worn, the more the spheroidal carbide appears at the surface, and the roll surface becomes rough, while still maintaining good biting properties.

The roll surface in conventional rolls has often been found to deteriorate due to deep heat cracking or to plastic flow of the roll material. Deterioration in either case can be avoided by means of this invention, growing spheroidal carbide, up to about 1 to 2 $\mu m\phi$, in the matrix.

We have accordingly discovered that the distribution metallurgy of the carbide in the roll matrix is most important. More specifically, heat treatment control is important for realizing a substantially complete and substantially spheroidal carbide formation. Furthermore, based upon a balance of progressive rate of work hardness and wear, we have discovered that the hardness of the roll surface (Shore scleroscope hardness Hs) must be about 29 to 34. When this hardness is about 29Hs or less, the holding force of the carbide is insufficient to hold the seamless pipe material, and the wear resistance of the roll is accordingly reduced. If the hardness is greater than about 34Hs or more, more specifically when a material such as stainless steel having a high resistance to distortion at high temperatures is rolled, poor biting properties result. Moreover, the chemical composition of the roll material is important so that the wear resistance and the biting properties may be appropriately adjusted. It is advantageous to provide a cooling rate after forging and a heat treatment for two-stage spheroidal carbide formation, so that creation of an unsuitable network carbide can be avoided.

Accordingly, a high carbon cast steel is the preferred roll material, in combination with special forging and heat treatment performed for making the roll.

A forged roll according to this invention, for rolling a seamless steel pipe, comprises a high carbon alloy cast steel comprising about 1.10–1.85 wt % carbon, about 0.3–1.2 wt % silicon, about 0.4–1.5wt % manganese, about 0.5–2.0 wt % nickel, about 0.5–20 wt % chromium and a remaining portion substantially consisting of iron, wherein spheroidal carbide covers about 35–55% of the area of the roll metallurgical structure.

In order to ensure obtaining a preferred metallurgical structure, there is provided a forged roll for rolling a seamless steel pipe, wherein at least one of about 0.1–1.0 wt % molybdenum, about 0.1–1.0 wt % vanadium and about 0.1–1.0 wt % tungsten is added to the high carbon alloy cast steel.

According to a further embodiment of the invention, the total content of elements that are detrimental to forging of high carbon alloy cast steel, such as phosphorus, sulfur, copper, arsenic, tin, lead, zinc, antimony and bismuth is about 0.2 wt % or less.

According to still further embodiment of the invention, there is provided a forged roll for rolling a seamless steel pipe, wherein about 90 area % or more of the matrix of the roll metallurgical structure is occupied by a ferrite structure.

According to still further embodiment of the invention, there is provided a forged roll for rolling a seamless steel pipe, wherein the roll surface hardness ranges from about 29 to 34Hs.

According to a still further embodiment of the invention, there is provided a forged roll for rolling a seamless steel pipe, wherein a high carbon alloy cast steel, which contains about 1.10–1.85 wt % carbon, about 0.3–1.2 wt % silicon, about 0.4–1.5 wt % manganese, about 0.5–2.0 wt % nickel and about 0.5–2.0 wt % chromium and a remaining portion substantially consisting of iron, is hot-forged and roll-shaped, the roll is cooled down to about 600° C. or less at a cooling rate of about 2.5° C./min or more, a first stage heat treatment for spheroidal carbide formation is performed so that the roll is maintained for about five hours or more at a temperature from about (Acm minus 10° C.) to (Acm minus 100° C.), and yet a second stage heat treatment for spheroidal carbide formation is performed so as to make a spheroidal carbide, and the roll metallurgical structure is about 35 to 55% area occupied with the spheroidal carbide. The expression "Acm" denotes the temperature at the Acm transformation point.

According to a still further embodiment of the invention, there is provided a method of manufacturing a forged steel roll for rolling a seamless steel pipe, wherein at least one of about 0.1–1.0 wt % molybdenum, about 0.1–1.0 wt % vanadium and about 0.1–1.0 wt % tungsten is present in the high carbon alloy cast steel.

According to still further embodiment of the invention, there is provided a method of manufacturing a forged roll for rolling a seamless steel pipe, wherein the total content of detrimental-to-forging elements, comprising one or more of phosphorus, sulfur, copper, arsenic, tin, lead, zinc, antimony and bismuth, is about 0.2 wt % or less.

For ideal heat treatment, according to a still further embodiment of the invention, there is provided a method of manufacturing a forged roll for rolling a seamless steel pipe, wherein special heat treatment is performed for spheroidal carbide formation at a temperature range from about 700 to 840° C.

According to the present invention, breaking away from conventional concepts, the forged roll is constructed so as to mainly contain a ferrite matrix where spheroidal carbide is dispersed. Its softness well ensures good biting properties, and the spheroidal carbide formation assures good wear resistance. As a result, it is possible to provide a forged roll for rolling a seamless steel pipe, which combines two characteristics that have conventionally seemed to be unrealizable in one and the same roll.

Figure 5:
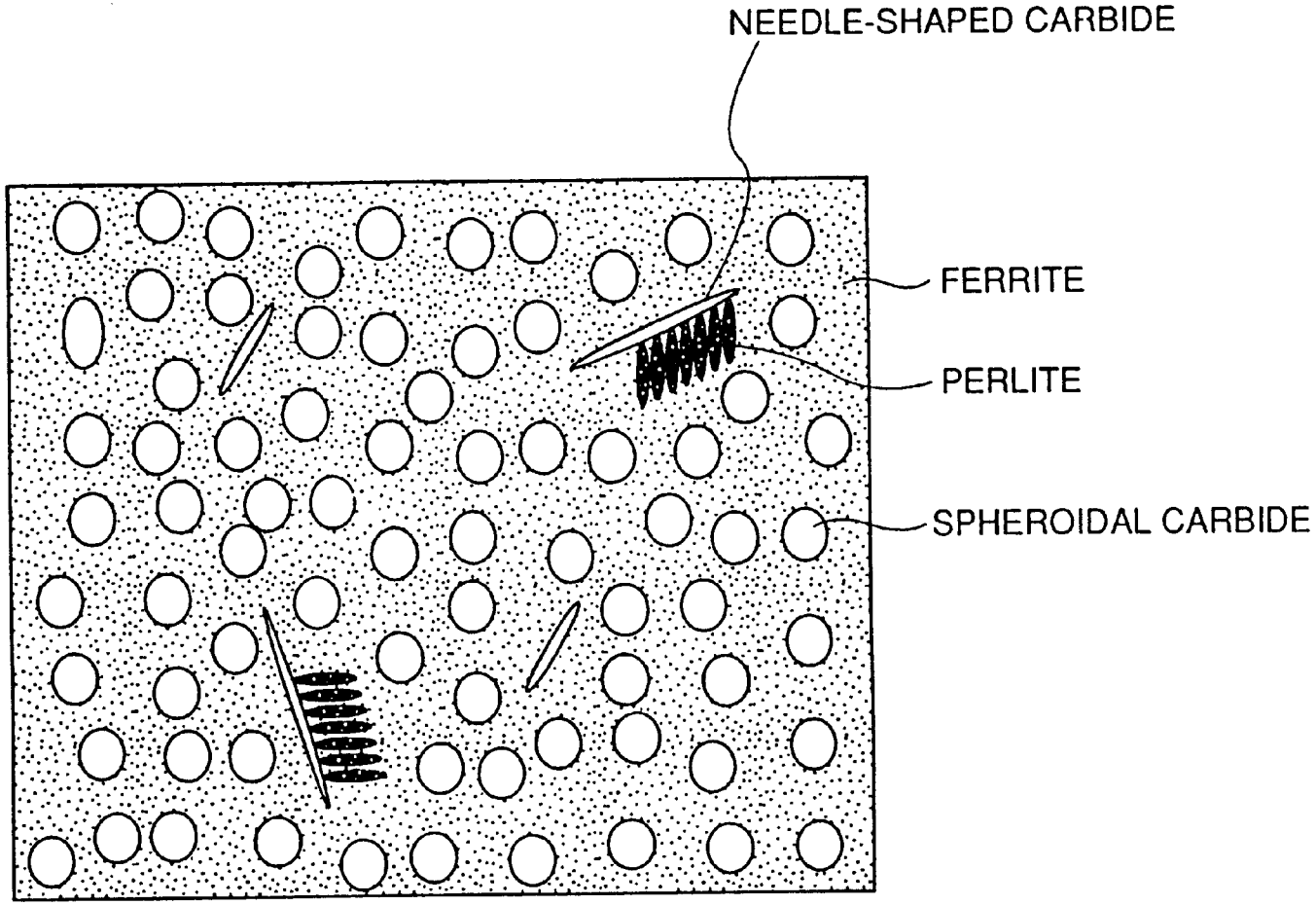
FIG. 5 illustrates a preferable metallurgical structure in accordance with this invention.

FIG. 5 of the drawings schematically shows a roll metallurgical structure obtained by the present invention. Unlike a conventional high carbon type cast steel roll, Adamite roll or the like, the roll metallurgical structure has an excellent structure in which spheroidal carbide is uniformly dispersed and deposited throughout.

In examining a roll according to this invention, a sample may be taken near a roll surface layer and observed under a microscope, so that the roll metallurgical structure may be investigated. More concretely, a sample surface may be planished and ground and etched by nital, which causes a layered perlite to be blackened. In this state, a black area portion may be measured by means of an image analysis apparatus, so that an area ratio of the layered perlite may be measured.

Similarly, the planished ground sample may be etched by a carbide etching reagent, so that the layered perlite and the carbide are colored black. According to the present invention, the carbide comprises a trace of needle-shaped carbide and considerable spheroidal carbide. In this state, the black portion area may be measured by image analysis apparatus, so that the area of the layered perlite plus the spheroidal carbide is measured. Accordingly, the following equations may be expressed:

Spheroidal carbide area=area of (layered perlite+spheroidal carbide)−layered perlite area (Equation 1), and Ferrite area=total area−area of (layered perlite+spheroidal carbide), (Equation 2), where total area=spheroidal carbide area+matrix area, and where matrix area=layered perlite+ferrite area

DETAILED DESCRIPTION OF THE PREFERRED EMBODIMENTS

The preferred metallurgical structure of the roll is limited by post-forging cooling and heat treatment for first-and second-stage spheroidal carbide formation so that two phases, that is, a ferrite and a spheroidal carbide may co-exist. Preferred chemical compositions are accordingly set forth.

Chemical Composition

Carbon: about 1.10 to 1.85 wt %

The carbon is a main component of the carbide-forming element, and is important to contribute good wear resistance. At least about 1.10 wt % carbon or more is necessary. In case of about 1.10 wt % carbon or less, it is difficult to form coarse spheroidal carbide. In the case of about 1.85 wt % carbon or more, much eutectic carbide is generated, thereby resulting in surface roughness. Accordingly, about 1.10 wt % and 1.85 wt % are defined as the upper limit and the lower limit for carbon, respectively. A most preferable carbide content ranges from about 1.3 to about 1.80 wt %.

Silicon: about 0.3 to 1.2 wt %

The silicon is an important alloying element of cast iron. About 0.3 wt % silicon or more is necessary. If about 1.2 wt % silicon or more exists, there is a probability of an interaction with other alloy elements wherein carbon is excessively deposited to a matrix in the heat treatment, which causes the roll biting property to deteriorate. Accordingly, the upper limit of the silicon is about 1.2 wt %.

Manganese: about 0.4 to 1.0 wt %

The manganese is added to the roll together with the silicon for deoxidization of molten iron in the steel manufacturing process. About 0.4 wt % manganese or more exists. If too much manganese is contained in the roll, roll toughness is reduced. Accordingly, the upper limit is about 1.0 wt % or less.

Chromium: about 0.5 to 2.0 wt %

The chromium is essential for forming the carbide. More specifically, in order to form the coarse spheroidal carbide, about 0.5 wt % chromium or more is necessary. However, if about 2.0 wt % chromium or more is added to the roll, the roll's heat crack resistance property deteriorates. Accordingly, about 2.0 wt % is defined as the upper limit.

The following conditions relate to elements for obtaining more preferable metallurgical structures.

Molybdenum: about 0.1 to 1.0 wt %

The molybdenum is an important element for carbide formation. About 0.1 wt % or more of molybdenum is effective. When the molybdenum is added at the same time with a main alloy component, that is, chromium, the molybdenum tends gradually to increase the carbide content. Furthermore, when about 1.0 wt % molybdenum or more is added to the roll, coarse bar carbide formation upon heat treatment cannot often be prevented. Accordingly, about 1.0 wt % is defined as the upper limit.

Vanadium: about 0.1 to 1.0 wt %

The vanadium is an important element for carbide formation. About 0.1 wt % or more of vanadium is effective. When the vanadium is added at the same time with the main alloy component, that is, the chromium, the vanadium tends to gradually increase the carbide content. Furthermore, when about 1.0 wt % vanadium or more is added to the roll, coarse bulk carbide formation by heat treatment cannot usually be prevented. Accordingly, about 1.0 wt % is defined as the upper limit.

Tungsten: about 0.1 to 1.0 wt %

The tungsten also achieves the same effect as the molybdenum for carbide formation. 0.1 wt % tungsten or more is effective. When the tungsten is added at the same time with the chromium, the tungsten tends to gradually increase the carbide content. However, when about 1.0 wt % tungsten or more is added to the roll, coarse bar carbide formation upon heat treatment cannot usually be prevented. Accordingly, about 1.0 wt % is defined as the upper limit. Total amount of detrimental-to-forging elements: about 0.2 wt % or less The effect of impurity elements relative to forgeability has been investigated in detail. When each impurity element exists independently, phosphorus must be less than about 0.03 wt %, and sulfur, tin and arsenic must be less than about 0.02 wt % respectively. When the respective impurity elements exceed the above amounts, the roll characteristics of heat cracking, resistance and toughness deteriorate. Furthermore, in general, many hyper-eutectoid cast steels tend toward reduced forgeability; when the impurity contents exceed about 0.2 wt %, more uniform forging becomes difficult.

Heat Treatment Conditions

1) Cooling after forging

It is necessary to adjust distribution of spheroidal carbide so that good biting properties may be maintained. It is necessary to provide the roll with denseness of metallurgical structure due to forging, and with toughness, to prevent network carbide from depositing on the roll matrix upon slow-cooling from an austenite state.

Thus, it is necessary to increase the intercrystalline area on the metallurgical structure and to relatively increase the cooling rate. A roll having a fine structure (large intercrystalline area) forged at a forging ratio of 1.5 to 3 may be cooled at a cooling rate of about 2.5° C./min so that a temperature ranging from about 900° C. to 800° C. may be reduced to about 600° C. The following heat treatment for spheroidal carbide formation causes network carbide easily to form spheroidal carbide. However, when the cooling rate is less than about 2.5° C./min, the following heat treatment for spheroidal carbide formation cannot decompose the network carbide. Accordingly, in the present invention, the cooling rate must be carefully adjusted and maintained. The "forging ratio" denotes a ratio of section area (before forging)/(after forging).

2) First stage heat treatment for spheroidal carbide formation

In a roll having a component range according to the present invention, a temperature range from about (Acm minus 10° C.) to (Acm minus 100° C.) is maintained for about five hours or more, which enables network carbide to be decomposed. A first spheroidal carbide formation is accomplished by a synergistic effect with cooling after the forging. When a higher temperature than the above-described temperature is maintained, there is a danger that the metallurgical structure will convert completely to austenite. In this case, the network carbide is not decomposed, resulting in inferior roll biting properties. In addition, when the first stage heat treatment for spheroidal carbide formation is started at a lower temperature than about (Acm minus 100° C.), network coarse bar carbide or bulk carbide remains. In this case, the roll heat crack resistance becomes worse, and the roll surface easily breaks off similarly to a conventional Adamite type roll.

3) Second stage heat treatment for spheroidal carbide formation

In a roll having a component range according to the present invention, preferably, the second stage heat treatment for spheroidal carbide formation is performed within the range from about 700° C. to 840° C., which enables the spheroidal carbide to be coarse. This temperature range is maintained, so that the carbide alone, which is generated by the first stage heat treatment for the spheroidal carbide formation and has a relatively large diameter, is dispersed as a core. In such a manner, the carbide grows to large carbide upon slow cooling.

Moreover, according to a roll manufacturing method according to the present invention, the importance is that a forging-fined metallurgical structure is utilized and, aside from the decomposition of the network carbide, most of the roll matrix (90 area % or more of the matrix) is changed to the ferrite phase. Since deterioration of roll biting properties results from a work hardness of the matrix, the ferrite phase, which is more difficult to work-harden than a perlite phase, is more advantageous. Furthermore, since the perlite phase has the lower limit of approximately 35 of Shore scleroscope hardness Hs, its lower limit is already close to the limit hardness necessary for maintaining good biting properties. For this reason, according to the present invention, the ferrite phase is the roll matrix.

We are not aware of any prior art wherein a ferrite phase having inferior wear resistance properties is positively used as the matrix in the forged roll for rolling a seamless steel pipe in which a good wear resistance property is required. The present invention is characterized by this.

EMBODIMENTS

Manufacturing Example 1

Molten iron is melted and refined and adjusted to have a composition as shown in the present invention 1 in Table 1. After the molten iron is outgassed by vacuum treatment, the molten iron is cast, forming bulk steel. Next, the steel bulk is forged at a total forging ratio of about 1.8 to 2.3 so that it may be sleeve-roll shaped so as to have a barrel outer diameter of 1185 mm, a barrel inner diameter of 508 mm and a barrel length of 780 mm. Its metallurgical structure is fined. After forging, once the roll is cooled down to 600° C. by a forced air cooling at a cooling rate of about 3° C./min on the roll material surface, a first stage heat treatment for spheroidal carbide formation is performed, wherein the roll is reheated up to 900° C. and 900° C. is held for seven hours. Thenceforth, a temperature range from 900 to 600° C. is air-cooled at a cooling rate of approximately 3° C./min on the roll material surface. After the roll center portion has cooled to 600° C., a second stage heat treatment for spheroidal carbide formation is performed; the roll is reheated up to 830° C. and so held for ten hours. Next, the roll is again slow-cooled to 600° C. at a cooling rate of 9.5° C./h. Finally, a forged product of such a heat treatment is mechanically worked, so that a sleeve roll is completed.

TABLE 1

| | C | Si | Mn | P | S | Ni | Cr | Mo | V | W | Al | Total of detrimental elements (wt. %) | $A_{cm}$ (° C.) |
|---|---|---|---|---|---|---|---|---|---|---|---|---|---|
| The present invention 1 | 1.35 | 0.50 | 0.70 | 0.010 | 0.009 | 0.45 | 1.20 | 0.32 | — | — | 0.021 | 0.09 | 915 |
| The present invention 2 | 1.36 | 0.55 | 0.72 | 0.012 | 0.007 | 0.51 | 1.19 | 0.12 | — | — | 0.024 | 0.09 | 920 |
| The present invention 3 | 1.45 | 0.60 | 0.68 | 0.012 | 0.007 | 0.48 | 0.89 | 0.01 | — | 0.20 | 0.027 | 0.12 | 945 |
| The present invention 4 | 1.51 | 0.54 | 0.75 | 0.012 | 0.007 | 0.52 | 1.18 | 0.02 | 0.43 | — | 0.023 | 0.11 | 960 |
| The present invention 5 | 1.56 | 0.58 | 0 72 | 0.011 | 0.008 | 0.54 | 1.20 | 0.11 | 0.16 | — | 0.022 | 0.10 | 970 |
| The present invention 6 | 1.77 | 0.63 | 0.65 | 0.015 | 0.008 | 0.43 | 0.97 | 0.01 | — | 0.23 | 0.030 | 0.11 | 1025 |
| The present invention 7 | 1.39 | 0.70 | 0.71 | 0.011 | 0.009 | 0.46 | 1.25 | — | — | — | 0.023 | 0.10 | 921 |
| Conventional cast steel | 0.72 | 0.56 | 0.76 | 0.016 | 0.010 | 0.41 | 0.98 | 0.28 | — | — | 0.025 | 0.10 | — |

Usage Example

The sleeve roll is thermally inserted into an arbor (core material) by SCM440 stipulated for JIS G 4105 chromium molybdenum steel. The sleeve roll is assembled into a piercer roll. The piercer roll is set to a Mannesmann type piercer, and a material to be rolled is pierced and rolled. A usage result is evaluated by the number of materials to be rolled which pass through until roll exchange became necessary. The result is compared to the rolls manufactured by conventional casting (referred to as a cast roll below), which is shown in Table 2. As clearly shown in Table 2, when the material to be rolled is a 13Cr type stainless steel having a high resistance to distortion, the roll considerably differs from a conventional roll. It is found that longevity of the roll is three-times or more longer than that of the conventional roll. In addition, when the roll is used for pierce-rolling a carbon steel, the life of roll is increased up to 50% more. Furthermore, by the use of the roll according to the present invention, poor biting was not experienced, though it had heretofore been experienced when the 13Cr type stainless steel was rolled.

TABLE 2

| | Roll surface hardness (Hs) | Ratio of spheroidal carbide area in whole area (%) | In matrix Ratio of ferrite area (%) | In matrix Ratio of perlite area (%) | Number of 13Cr type stainless rolled materials | Number of carbon steel rolled materials |
|---|---|---|---|---|---|---|
| The present invention 1 | 31 | 38 | 95.5 | 4.5 | 2250 | 15600 |
| The present invention 2 | 30 | 44 | 100 | 0.0 | 2480 | 16050 |
| The present invention 3 | 29 | 45 | 100 | 0.0 | 2380 | 15780 |
| The present invention 4 | 33 | 40 | 90.5 | 9.5 | 2370 | 14530 |
| The present invention 5 | 31 | 50 | 94.5 | 5.5 | 2640 | 15650 |
| The present invention 6 | 34 | 40 | 90.5 | 9.5 | 2380 | 16870 |
| The present invention 7 | 32 | 42 | 97.5 | 2.5 | 2020 | 14920 |
| Conventional cast steel | 38 | 0 | 0 | 100 | 675 | 9700 |

Figure 1:
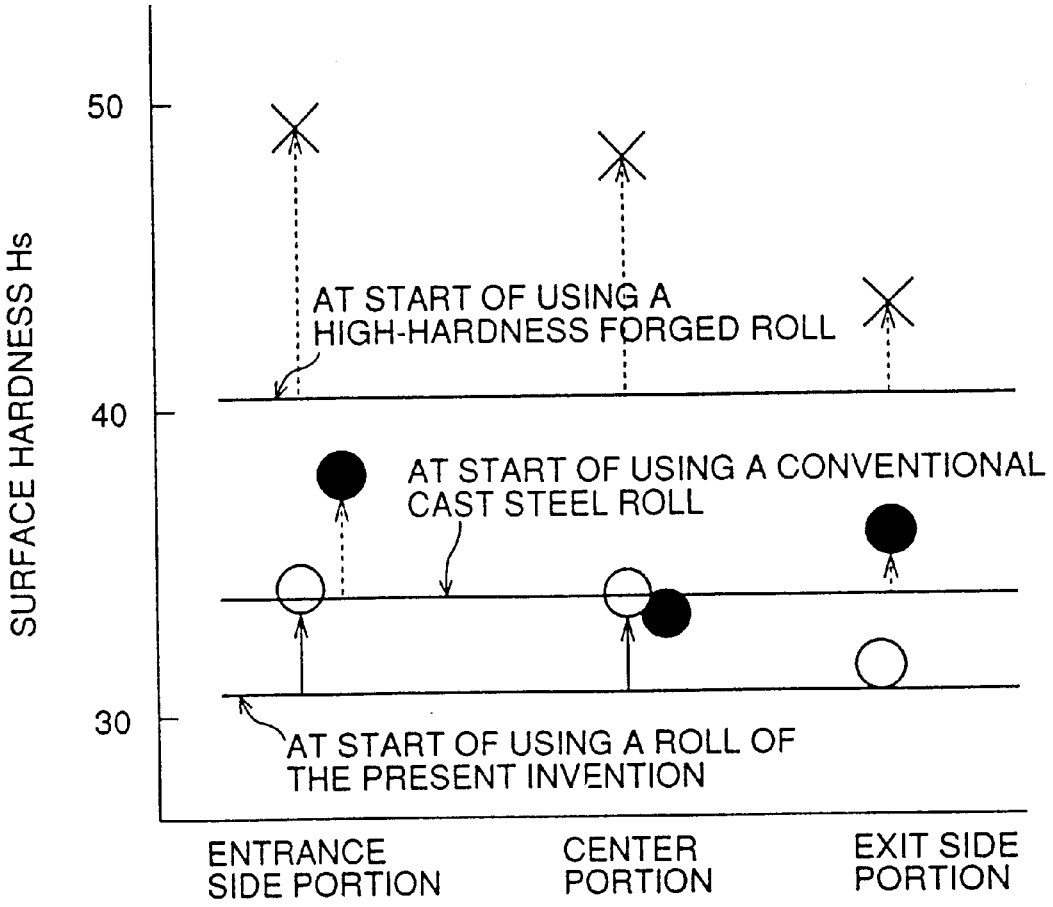
FIG. 1 shows relative Shore scleroscope hardness distribution relating to each portion (position) of a piercer roll before and after used.

The roll according to the present invention, a conventional forging type high-hardness roll and a casting type roll were used for piecing the same type of material, respectively. In FIG. 1 are shown Shore scleroscope hardnesses Hs distribution of a surface relating to the above-described portions of the roll. As shown in FIG. 1, in a forging type high-hardness roll in which poor biting occurs, the hardness was high before use, and the hardness at the roll entrance side portion 2 and the roll center portion 3 was further increased due to use. In the cast steel type roll in which surface roughness was increased so that the product surface deteriorated, and the roll according to the present invention, the increase of hardness due to use was less.

Figure 2:
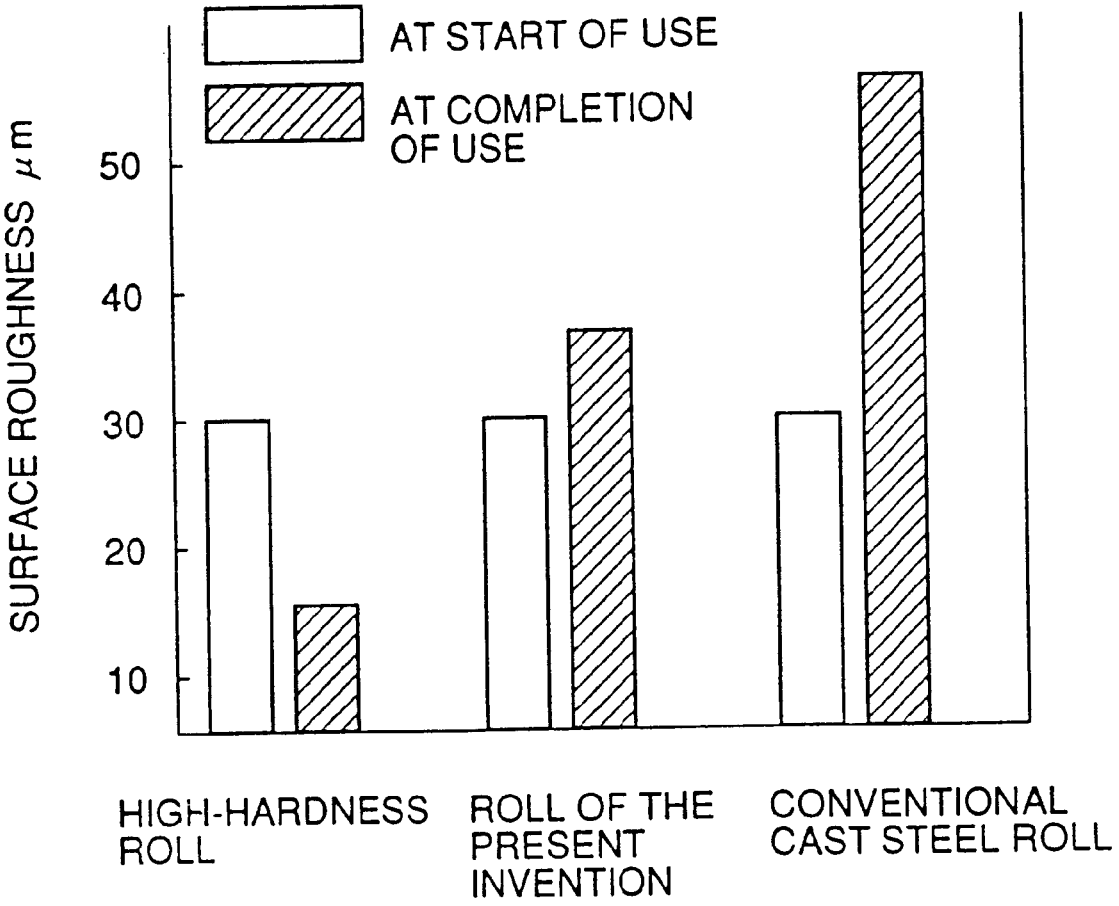
FIG. 2 shows a comparison of surface roughness at a center portion before and after the piercer roll is used.

Furthermore, FIG. 2 shows steel surface roughness at the roll center portion 3. As shown in FIG. 2, the roll according to the present invention has more surface roughness, compared to the high-hardness roll. This is a useful surface roughness for maintaining good biting properties. According to the roll of the present invention, it is possible to exhibit, at the same time, a wear progress and a self-recovery, and to always maintain an appropriate surface roughness.

As described in detail above, according to the present invention, the roll metallurgical structure is so constructed that a coarse spheroidal carbide (about 1 to 2 $\mu$mφ) is dispersed in a ferrite-phase matrix. Accordingly, an appropriate roll surface roughness can be maintained, thereby causing excellent biting properties and wear resistance properties. As a result, it is possible to achieve considerable roll longevity.

What is claimed is:

1. A method of manufacturing a forged roll for rolling a seamless steel pipe, wherein a high carbon alloy cast steel, which comprises about 1.10–1.85 wt % carbon, about 0.3–1.2 wt % silicon, about 0.4–1.5 wt % manganese, about 0.5–2.0 wt % nickel and about 0.5–2.0 wt % chromium and a remaining portion substantially consisting of iron, is hot-forged so as to be roll-shaped, said roll is cooled down to about 600° C. or less at a cooling rate of about 2.5° C./min or more, a first stage heat treatment for spheroidal carbide formation is performed wherein said roll is maintained for about five hours or more at a temperature from about (Acm minus 10° C.) to (Acm minus 100° C.), and wherein a second stage heat treatment is performed and effects spheroidal carbide formation within said roll.

2. The method according to claim 1, wherein at least one of about 0.1–1.0 wt % molybdenum, about 0.1–1.0 wt % vanadium and about 0.1–1.0 wt % tungsten is added to said high carbon alloy cast steel.

3. The method according to claim 1, wherein the total content of detrimental-to-forging elements of said high carbon alloy cast steel, selected from the group consisting of phosphorus, sulfur, copper, arsenic, tin, lead, zinc, antimony and bismuth, is about 0.2 wt % or less.

4. The method according to claim 2, wherein the total content of detrimental-to-forging elements of said high carbon alloy cast steel, selected from the group consisting of phosphorus, sulfur, copper, arsenic, tin, lead, zinc, antimony and bismuth, is about 0.2 wt % or less.

5. The method according to claim 1, wherein said second stage heat treatment for spheroidal carbide formation is performed at a temperature range from about 700 to 840° C.

6. The method according to claim 2, wherein said second stage heat treatment for spheroidal carbide formation is performed at a temperature range from about 700 to 840° C.

* * * * *

UNITED STATES PATENT AND TRADEMARK OFFICE

CERTIFICATE OF CORRECTION

PATENT NO. : 5,950,310
DATED : September 14, 1999
INVENTOR(S) : Kanayama et al

It is certified that error appears in the above-identified patent and that said Letters Patent is hereby corrected as shown below:

In column 3, at approximately line 38 which begins "% nickel", please change "20" to -- 2.0 -- .

Signed and Sealed this

Twelfth Day of September, 2000

*Attest:*

Q. TODD DICKINSON

*Attesting Officer*

*Director of Patents and Trademarks*